US011096531B2

(12) United States Patent
Edwards et al.

(10) Patent No.: US 11,096,531 B2
(45) Date of Patent: Aug. 24, 2021

(54) ADJUSTABLE BATHROOM GRAB BAR ASSEMBLY

(71) Applicant: LIBERTY HARDWARE MFG. CORP., Winston-Salem, NC (US)

(72) Inventors: Neil Edwards, Kernersville, NC (US); John Dutton, Chicago, IL (US); Matthew Klein, Apex, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 103 days.

(21) Appl. No.: 16/117,620

(22) Filed: Aug. 30, 2018

(65) Prior Publication Data

US 2020/0069122 A1 Mar. 5, 2020

(51) Int. Cl.
*A47K 17/02* (2006.01)

(52) U.S. Cl.
CPC ..... *A47K 17/024* (2013.01); *A47K 17/022* (2013.01)

(58) Field of Classification Search
CPC ..... A47K 17/024; A47K 17/022; B60N 3/02
See application file for complete search history.

(56) References Cited

U.S. PATENT DOCUMENTS 3,082,473 A * 3/1963 West ..... A45C 13/26 16/445
4,932,090 A 6/1990 Johansson
4,944,478 A 7/1990 Sullivan
4,976,455 A * 12/1990 Brammer, Sr. ..... B60P 3/36 16/319
5,192,837 A 3/1993 Bolton
5,301,570 A 4/1994 Li
5,586,352 A 12/1996 O'Brien et al.
6,098,492 A 8/2000 Juchniewicz et al.
6,131,213 A 10/2000 Sarff
6,266,850 B1 7/2001 Williams et al.
(Continued)

FOREIGN PATENT DOCUMENTS

DE 202014001814 U1 7/2014
DE 202016105133 U1 11/2016
(Continued)

OTHER PUBLICATIONS

U.S. Office Action for U.S. Appl. No. 16/402,382, dated Aug. 5, 2020, 14 pages.

*Primary Examiner* — Victor D Batson
*Assistant Examiner* — Matthew J Sullivan
(74) *Attorney, Agent, or Firm* — Brooks Kushman P.C.; Lora Graentzdoerffer

(57) ABSTRACT

A handle assembly has a first handle with first and second end regions connected to and fixed relative to first and second mounts on a wall, respectively. A second handle extends longitudinally between third and fourth end regions, with the third end region connected to the first end region of the first handle. The first and second handles each have surfaces for grasping by a user. A position of the second grab bar is adjustable relative to the first grab bar by at least one of one of pivoting the second grab bar about the longitudinal axis of the first grab bar, pivoting the second grab bar about a horizontal axis adjacent to the first end region of the first grab bar, and sliding the second grab bar along the first grab bar. A method of installing the handle assembly is also provided.

12 Claims, 9 Drawing Sheets

(56) References Cited

U.S. PATENT DOCUMENTS

| | | | | |
|---|---|---|---|---|
| 6,581,245 | B2 * | 6/2003 | Jen | A45C 13/26 16/334 |
| 6,843,468 | B2 * | 1/2005 | Marshall | A47K 3/003 248/205.1 |
| 6,974,134 | B1 * | 12/2005 | Macri | B60N 3/023 16/412 |
| 7,195,232 | B2 | 3/2007 | Marshall et al. | |
| 7,249,395 | B2 | 7/2007 | Brammer, Jr. et al. | |
| D584,129 | S | 1/2009 | Miller | |
| D623,928 | S | 9/2010 | Weber | |
| 7,823,229 | B2 * | 11/2010 | O'Brien | A47K 17/024 4/573.1 |
| 7,849,564 | B2 * | 12/2010 | Miller | A47K 17/022 16/436 |
| 8,171,587 | B1 * | 5/2012 | Haessly | A61G 7/1025 5/662 |
| 8,474,921 | B2 | 7/2013 | Newkirk et al. | |
| 9,968,226 | B1 | 5/2018 | Anderson | |
| 10,457,182 | B2 * | 10/2019 | McKinnon | B60N 3/026 |
| 2007/0204437 | A1 * | 9/2007 | Hartmann, Jr. | B60N 3/023 16/444 |
| 2008/0289296 | A1 * | 11/2008 | Weber | A47K 3/003 52/835 |
| 2011/0203078 | A1 | 8/2011 | Farrow, Sr. | |
| 2016/0143494 | A1 * | 5/2016 | Thomas | A47K 17/024 4/254 |
| 2016/0368408 | A1 * | 12/2016 | Magoolaghan | B60N 3/026 |
| 2020/0069122 | A1 | 3/2020 | Edwards et al. | |

FOREIGN PATENT DOCUMENTS

| | | | |
|---|---|---|---|
| EP | 3158907 | A1 | 4/2017 |
| JP | S6195157 | A | 5/1986 |
| JP | S6195159 | A | 5/1986 |
| JP | 3723118 | B2 | 12/2005 |
| JP | 4100258 | B2 | 6/2008 |
| JP | 4399858 | B2 | 1/2010 |
| JP | 5257836 | B2 | 8/2013 |
| JP | 5979605 | B2 | 8/2016 |

* cited by examiner

ADJUSTABLE BATHROOM GRAB BAR ASSEMBLY

TECHNICAL FIELD

Various embodiments relate to grab bar assemblies for use in a bathroom.

BACKGROUND

A handle assembly is illustrated and described in U.S. Pat. No. 7,849,564 B2, which issued on Dec. 14, 2010 to F. Troy Miller.

SUMMARY

In an embodiment, a handle assembly is provided with first and second mounts, with each mount to mount to a wall. A first handle extends longitudinally between first and second end regions, with the first and second end regions connected to and fixed relative to the first and second mounts, respectively. A second handle extends longitudinally between third and fourth end regions. The third end region is connected for rotation to the first end region of the first handle such that the second handle is moveable from a first position with the second handle coaxially aligned with the first handle to a second position with the second handle angled relative to the first handle for grasping by a user.

In another embodiment, a handle assembly is provided with first and second mounts, with each mount to mount to a wall. A first handle extends along a longitudinal axis between first and second end regions. The first and second end regions are connected to and fixed relative to the first and second mounts, respectively. A second handle has third and fourth end regions each connected for rotation to the first handle such that the second handle pivots about the longitudinal axis, the third and fourth end regions spaced apart from one another such that an outer surface of the first handle therebetween is accessible for grasping by a user. A locking mechanism is provided to lock the second handle in one of a plurality of pivotal positions relative to the first handle. The locking mechanism has an engagement member to move in a radial direction relative to at least one of the first and second handles between an engaged position and a release position.

In yet another embodiment, a method of installing a grab bar assembly is provided. First and second mounts are mounted to a vertical wall surface with the first and second mounts aligned along a vertical axis. First and second end regions of a first grab bar are connected to the first and second mounts, respectively, such that the first grab bar is fixed relative to the first and second mounts. The first grab bar has a surface for grasping by a user that is spaced apart from the wall surface, and the first grab bar extends along a longitudinal axis parallel with the vertical axis. A third end region of a second grab bar is connected to the first grab bar. The second grab bar extends from the third end region to a fourth end region, and has a linear section for grasping by a user. A position of the second grab bar is adjusted relative to the first grab bar by at least one of one of pivoting the second grab bar about the longitudinal axis of the first grab bar, pivoting the second grab bar about a horizontal axis adjacent to the first end region of the first grab bar, and sliding the second grab bar along the first grab bar.

BRIEF DESCRIPTION OF THE DRAWINGS

FIG. 3 is a perspective view of a variation of the grab bar assembly as shown in

FIG. 1;

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Handle assemblies or grab bar assemblies may be provided in a bathroom environment to provide a grasping surface for a user. For example, people with mobility issues may use a grab bar to aid in movements such as sitting or standing, maintaining balance, and the like. Depending on the bathroom configuration or layout, it may be desirable to place and lock the grab bar into various positions, or to change the position of the grab bar for use by the user or for use by different users. Furthermore, it may be desirable to have a storage position to move the grab bar out of the way.

For example, the grab bar assembly may be provided to mount outside of, adjacent to, or within a shower or bath enclosure to guide and aid users as they transition into or out of the enclosure, with the grab bar assembly folding for storage when not in use. The grab bar assembly may aid users with mobility or balance issues or users with poor vision. The grab bar assembly also provides an additional grasping surface when used next to or within a bathing enclosure where water may increase the slipperiness of a floor surface, or where a sill, step, or other structure must be navigated by a user.

Figure 1:
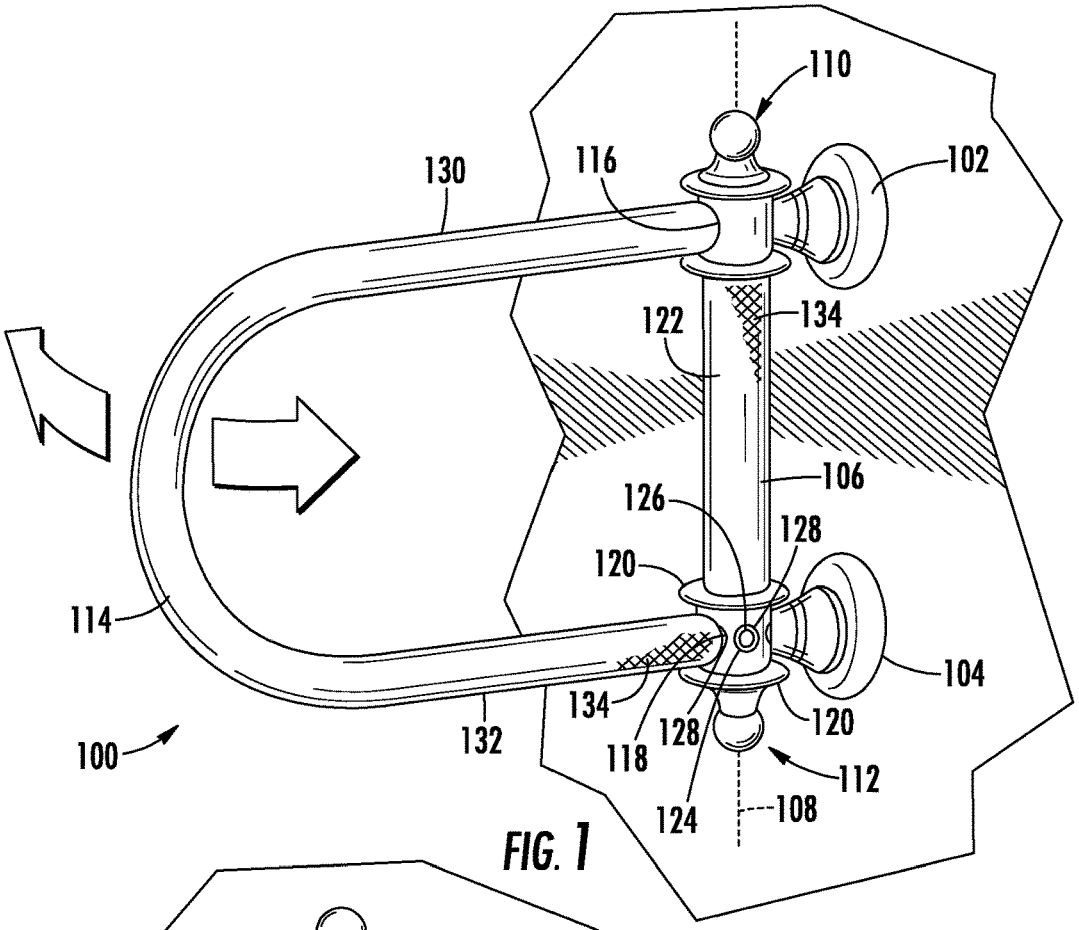
FIG. 1 is a perspective view of a grab bar assembly in a first position according to an embodiment.
Figure 2:
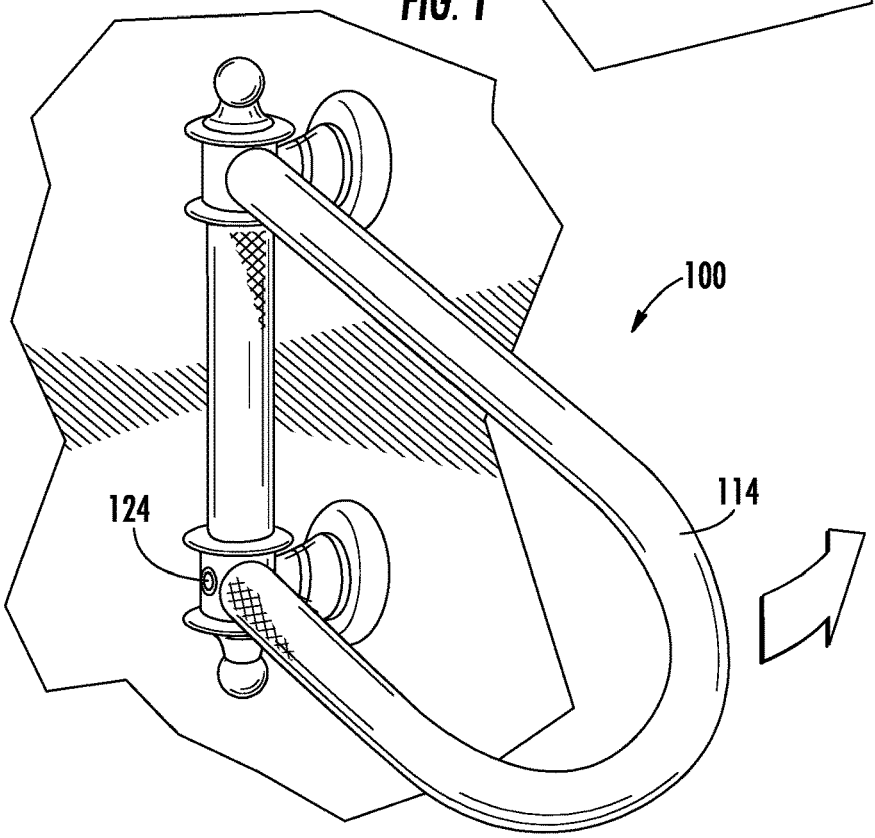
FIG. 2 is a perspective view of the grab bar assembly of FIG. 1 in a second position.

FIGS. 1-2 illustrate a grab bar assembly 100 or handle assembly 100 according to an embodiment. The assembly 100 has first and second mounts 102, 104, with each mount having associated hardware to fasten or connect the mount 102, 104 to a surface, such as a vertical wall surface in or adjacent to a bathing enclosure.

A first handle 106 or first grab bar 106 is provided and extends along a longitudinal axis 108 as shown. The first grab bar 106 has first and second end regions 110, 112 that are connected to and fixed relative to the first and second mounts 102, 104, respectively. In one example, the mounts 102, 104 are each provided with brackets to hold or connect to the first grab bar 106. The first grab bar 106 and longitudinal axis 108 may be oriented vertically or substantially vertically, e.g. within five to ten degrees of vertical. The first grab bar 106 may extend linearly as shown.

The mounts 102, 104 may be dimensioned to position the first grab bar 106 at a specified distance from the wall surface, e.g., a stand-off distance. In one example, the first grab bar 106 is positioned with 1.5 inches away of space or more between the first grab bar 106 and the wall surface or more. The first grab bar 106 may be fixed against translational or rotational movement.

The grab bar assembly 100 has a second handle 114 or second grab bar 114 with third and fourth end regions 116, 118. Each of the third and fourth end regions 116, 118 are rotatably connected to the first grab bar 106 such that the second grab bar 114 pivots about the longitudinal axis 108. In one example, each of the third and fourth end regions 116, 118 includes a sleeve sized to fit around the first grab bar 106. The first grab bar 106 may additionally have locating projections 120 to locate the second grab bar 114 relative to the first grab bar 106 along the longitudinal axis 108. In the example shown, the second grab bar 114 has a single, rotational degree of freedom about the longitudinal axis 108, and does not otherwise rotate or translate.

The second grab bar 114 is shown in a first, use position in FIG. 1, and is shown in a second position in FIG. 2. The position as shown in FIG. 2 may be a storage position with the second grab bar 114 being adjacent to, parallel to, or in contact with the wall surface. The second grab bar 114 may have additional positions to those shown, and in one example, is configured to move through up to 270 degrees of rotation after being mounted to a wall, e.g. near a corner. In other examples, the second grab bar may be limited to move through another range of motion, such as 180 degrees or 90 degrees based on the mounting location, as well as the intended use. Features such as limit stops may be provided to define the ends of the range of motion for the second grab bar 114.

The third and fourth end regions 116, 118 are spaced apart from one another along the longitudinal axis 108, and an outer surface 122 of the first grab bar 106 located between the third and fourth end regions 116, 118 is therefore accessible for grasping by a user. In one example, the outer surface 122 of the first grab bar 106 provides at least five continuous linear inches of a grasping surface. In other examples, the outer surface 122 has a linear grasping surface lying within a range of five to twelve inches, and may have a longer grasping surface in other examples.

The grab bar assembly 100 also has a pivotal locking mechanism 124. The locking mechanism 124 locks the second grab bar 114 in one of a plurality of pivotal positions relative to the first grab bar 106. The grab bar assembly 100 may have two positions as shown, or may have additional positions that are uniformly or non-uniformly spaced about the first grab bar 106 within the range of motion of the second grab bar 114. In one non-limiting example, a pivotal position for the second grab bar 114 is provided every 45 degrees through a range of motion of up to 270 degrees about axis 108. In another non-limiting example, a pivotal position for the second grab bar 114 is provided every 20-25 degrees through a range of motion of up to 180 degrees about axis 108.

The locking mechanism 124 has an engagement member 126 that moves in a radial direction relative to at least one of the first and second grab bars 106, 114 between an engaged position and a release position. The engagement member 126 of the locking mechanism 124 may be one of a spring pin, a snap button on a leaf spring, and a ball, or a ramp or other member. At least one of the first and second grab bars 106, 114 defines an aperture 128 or other feature associated with each of the plurality of pivotal positions for receiving the engagement member 126 and engaging the locking mechanism 124. In one example, the engagement member 126 is supported by the first grab bar 106 and a series of apertures 128 are defined by the second grab bar 114, such that the engagement member 126 extends outwardly through an aperture 128 in an engaged position and is moved radially inwardly to release the locking mechanism 124 and move the second grab bar 114. In another example, the engagement member 126 is supported by the second grab bar 114 and a series of apertures 128 are defined by the first grab bar 106 such that the engagement member 126 extends inwardly through an aperture 128 in an engaged position and is moved radially outwardly to release the locking mechanism 124. The user may need to radially move the engagement member 126 to release the mechanism 124, or in an alternative embodiment, the aperture 128 may be provided with ramp features such that providing a rotational force to the second grab 114 bar above a threshold causes the engagement member 126 to release. In yet another example, the engagement member 126 is provided by a ramp or other surface on one of the first and second grab bars 106, 114 that mates with and provides a frictional position limiter with a corresponding surface on the other of the first and second grab bars 106, 114.

The second grab bar 114 has a first linear section 130 adjacent to the third end region 116 for grasping by a user. The first linear section 130 may be substantially perpendicular to the first grab bar 106 and longitudinal axis 108, or substantially horizontal, e.g. within five to ten degrees of horizontal.

The second grab bar 114 also has a second linear section 132 adjacent to the fourth end region 118 for grasping by the user. The second linear section 132 may be substantially perpendicular to the first grab bar 106 and longitudinal axis 108, or substantially horizontal, e.g. within five to ten degrees of horizontal, and furthermore may be parallel to the first linear section 130.

The first and second linear sections 130, 132 may be connected by a curved section as shown or by another linear section. In one example, the first and second linear sections 130, 132 each provide at least five continuous linear inches of a grasping surface. In other examples, the first and second linear sections 130, 132 may each have a linear grasping surface lying within ranges of five to eighteen inches, five to twelve inches, twelve to eighteen inches, and may have other length grasping surfaces in other examples. The use of two connection points 116, 118 for the second grab bar 114 to the first grab bar 106 provides increased useful loading of the second grab bar 114, increased stability, and the ability to provide a second grab bar 114 with a longer lever arm that extends farther away from the mounts 102, 104 and the wall.

In various examples, the outer surface of the first grab bar 106 and/or the outer surface of the second grab bar 114 may be provided with a textured surface 134 and/or a coating 134 to provide additional grip for a user. For example, a textured surface may be provided by a knurled pattern, or another pattern or texture. A coating may be provided by a rubberized coating or the like. The coating may provide a softer surface, and may be solid, semi-transparent, or transparent.

Figure 3:
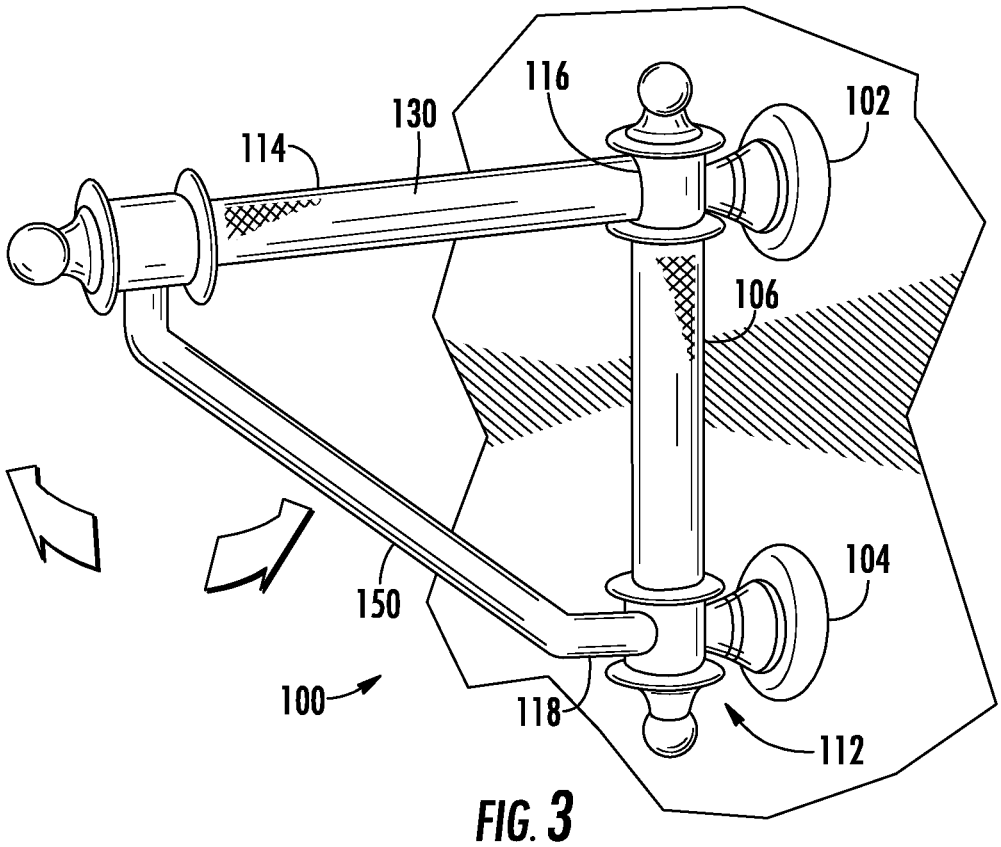

FIG. 3 illustrates a variation of the handle assembly or grab bar assembly 100 as shown in FIG. 1 with an alternative second handle or grab bar 114 rotatably connected to the first grab bar 106. Elements that are the same as or similar to those described above with reference to FIGS. 1-2 are given the same reference number for convenience.

The second handle 114 or second grab bar 114 in FIG. 3 has a first linear section 130 as described above with respect to FIG. 1. The second grab bar 114 also has a second linear section 150 adjacent to the fourth end region 118. The second linear section 150 may be provided for grasping by the user and/or may be provided for structural support of the second grab bar 114 by allowing for two connection points 116, 118 to the first grab bar 106. The second linear section 150 may be angled relative to the first grab bar 106, longitudinal axis 108, and the first section 130 of the second grab bar 114, and may extend from a distal end of the first linear section 130 to the second end region 112 of the first grab bar.

Figure 4:
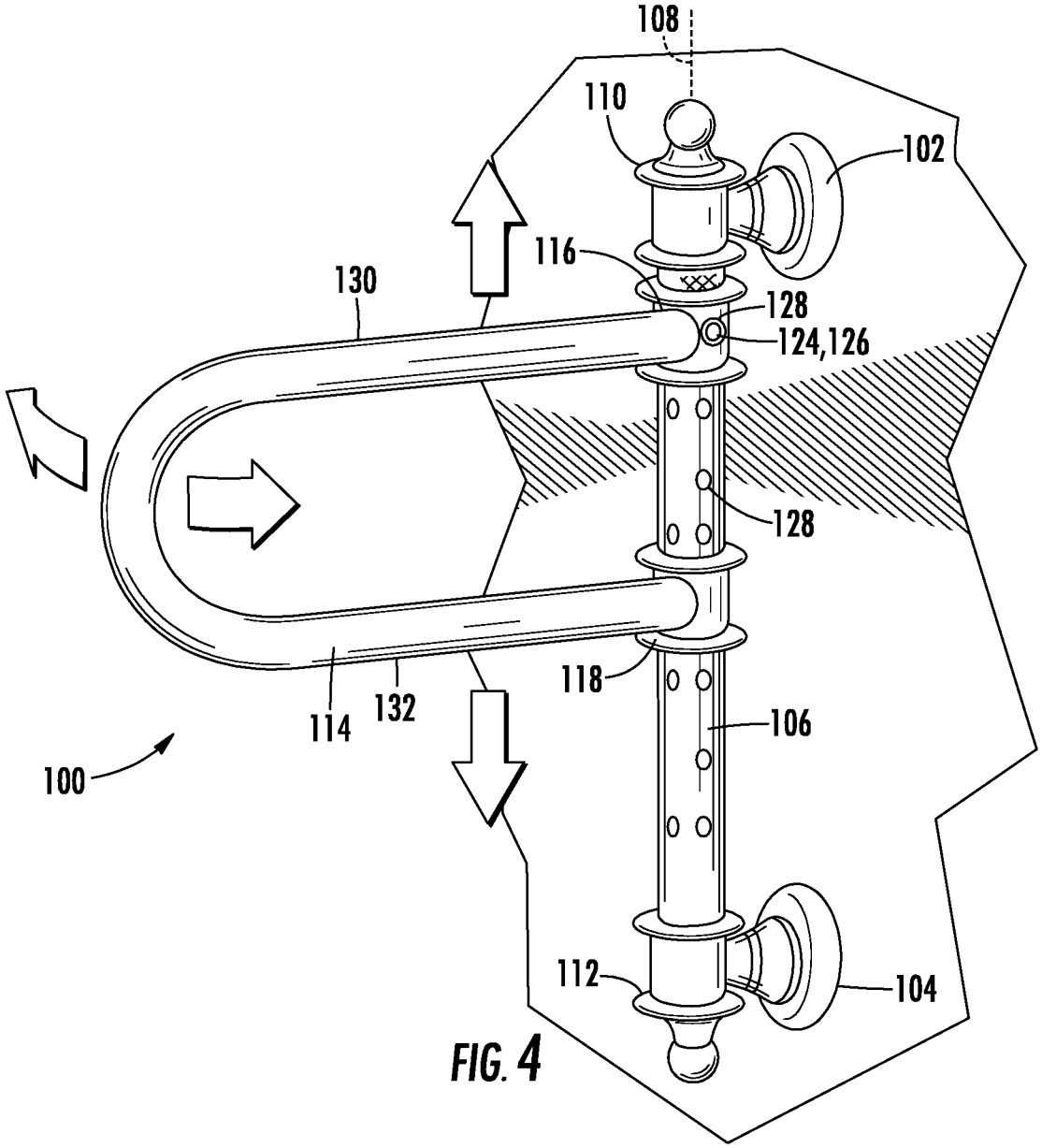
FIG. 4 is a perspective view of a grab bar assembly in a first position according to another embodiment.
Figure 5:
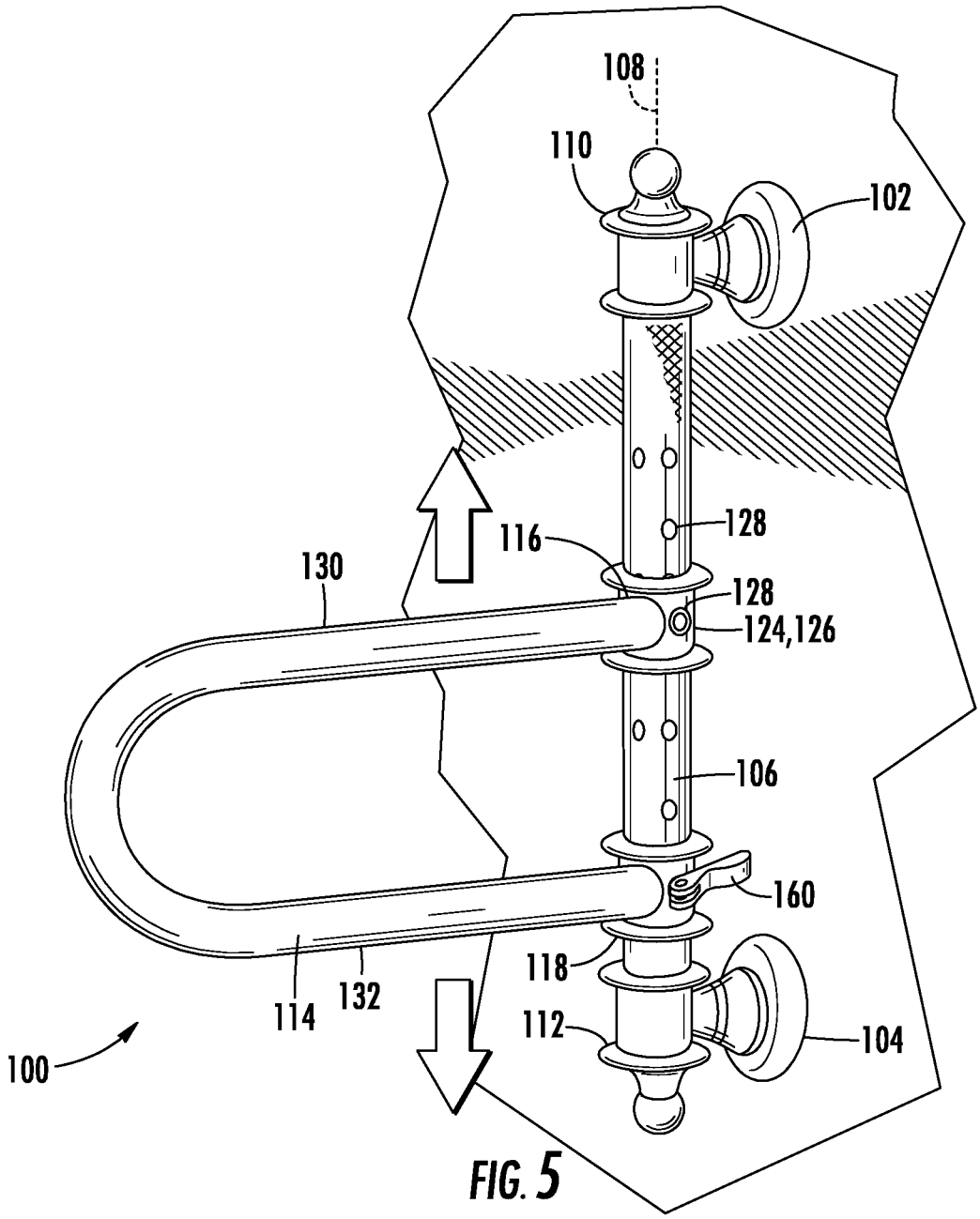
FIG. 5 is a perspective view of the grab bar assembly of FIG. 4 in a second position.
Figure 6:
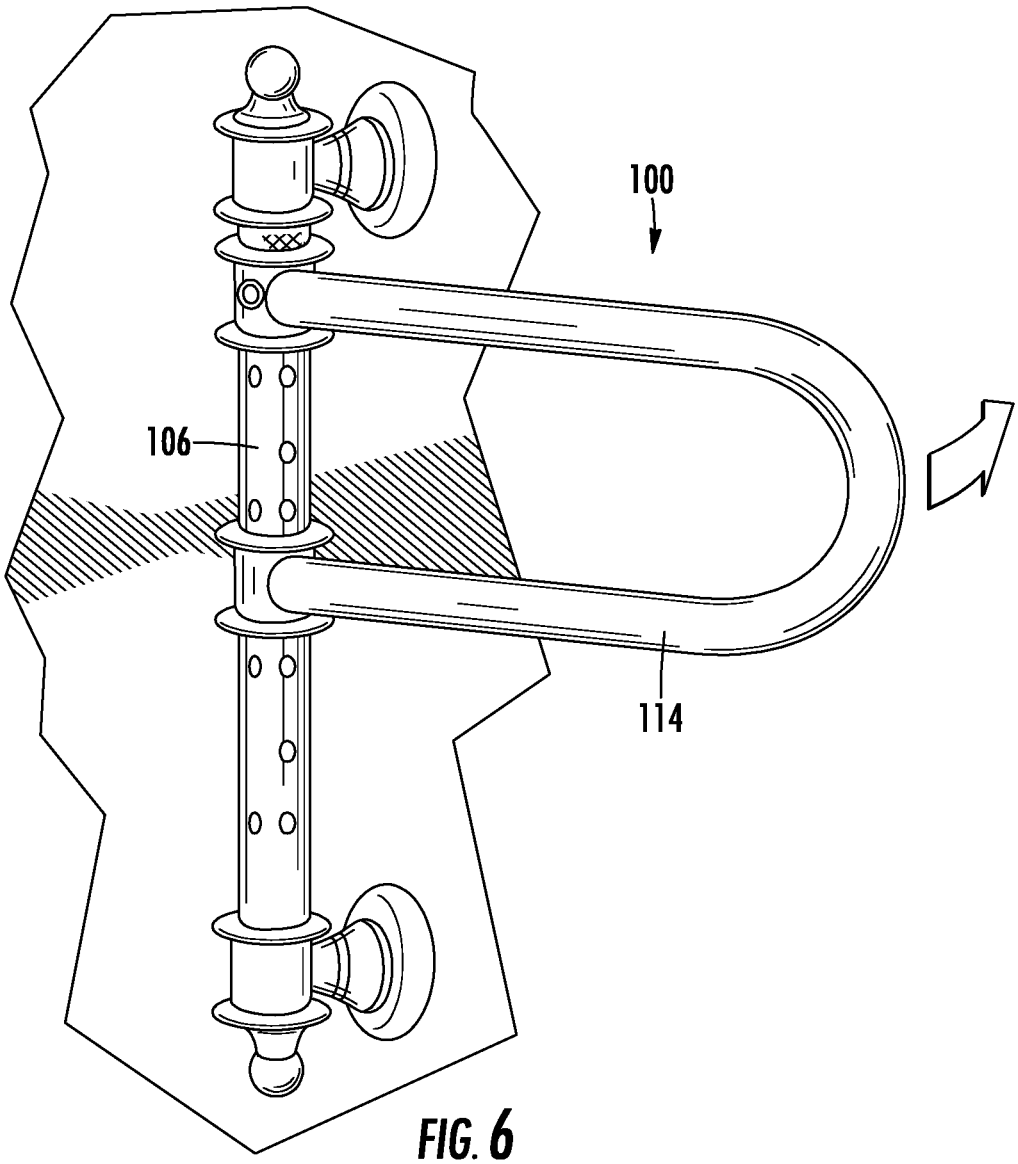
FIG. 6 is a perspective view of the grab bar assembly of FIG. 4 in a third position.

FIGS. 4-6 illustrate a handle assembly 100 or grab bar assembly 100 according to another embodiment. Elements that are the same as or similar to those described above with reference to FIGS. 1-2 are given the same reference number for convenience. The third and fourth ends 116, 118 of the second grab bar 114 are rotatably mounted to the first grab bar 106 such that the second grab bar 114 pivots about the longitudinal axis 108. The position of the second grab bar 114 may be controlled and locked using a pivotal locking mechanism 124 as described above.

In addition to the pivotal movement, the second grab bar 114 may slide or translate along the first grab bar 106. The third and fourth end regions 116, 118 of the second grab bar 114 are slideably connected to the first grab bar 106 such that the second grab bar 114 translates along the longitudinal axis 108 for height adjustment. A first longitudinal position of the second grab bar 114 is shown in FIG. 4, with the second grab bar 114 pivoted away from the wall surface. A second longitudinal position of the second grab bar 114 is shown in FIG. 5, with the second grab bar 114 pivoted away from the wall surface. The second grab bar 114 is also shown in another longitudinal position and rotated to be adjacent to or flush with the wall surface in FIG. 6. In one example, the first grab bar 106 allows for 24-36 inches of vertical adjustment of the second grab bar 114.

The second grab bar 114 may be locked into a plurality of longitudinal positions. In one example the pivotal locking mechanism 124 as described above is also used to longitudinally locate and lock the second grab bar 114 relative to the first grab bar 106, and additional apertures 128 or features to cooperate with the engagement member 126 may be provided at a plurality of longitudinal positions along the first grab bar 106 as shown in FIG. 4.

In another example, the grab bar assembly 100 has a second longitudinal locking mechanism 160 to lock the second grab bar 114 in one of a plurality of longitudinal positions relative to the first grab bar 106. The second locking mechanism 160 may be provided by a mechanism similar to the one described above for the pivotal locking mechanism 124, such as a spring pin, snap button, or the like. In other examples and as shown in FIG. 5, the longitudinal locking mechanism 160 may be provided by a lever pipe clamp that is integrated into one of the third and fourth end regions 116, 118 and surrounds the first grab bar 106.

Figure 7:
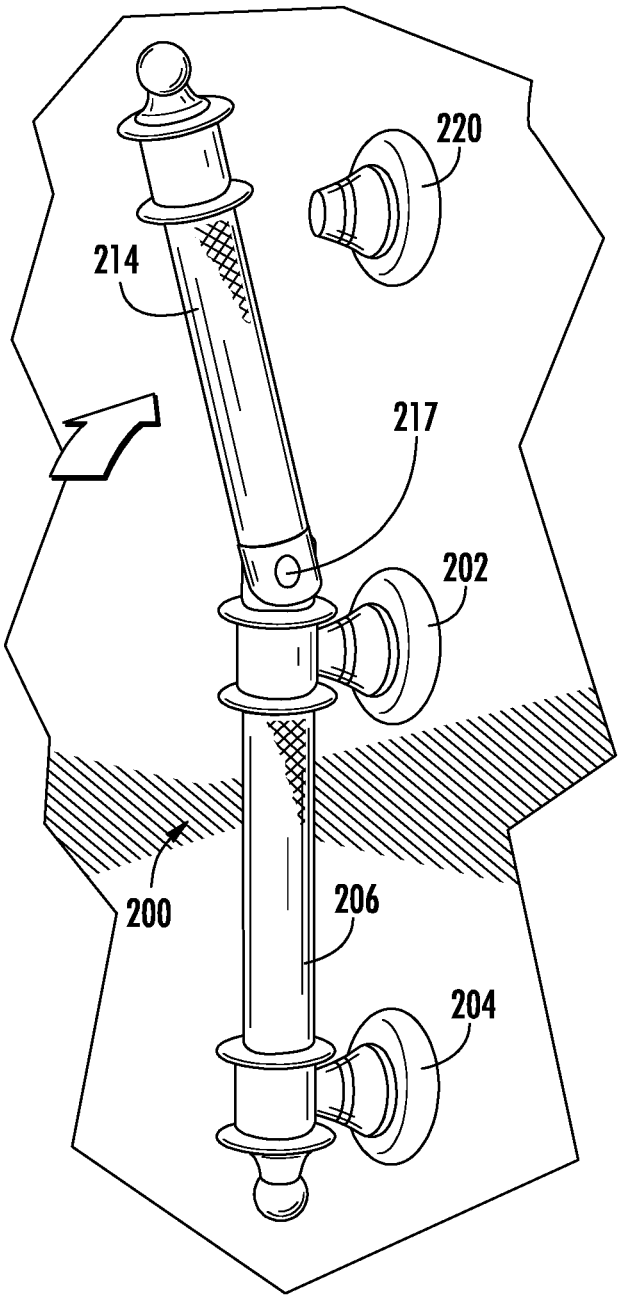
FIG. 7 is a perspective view of a grab bar assembly in a first position according to yet another embodiment.
Figure 8:
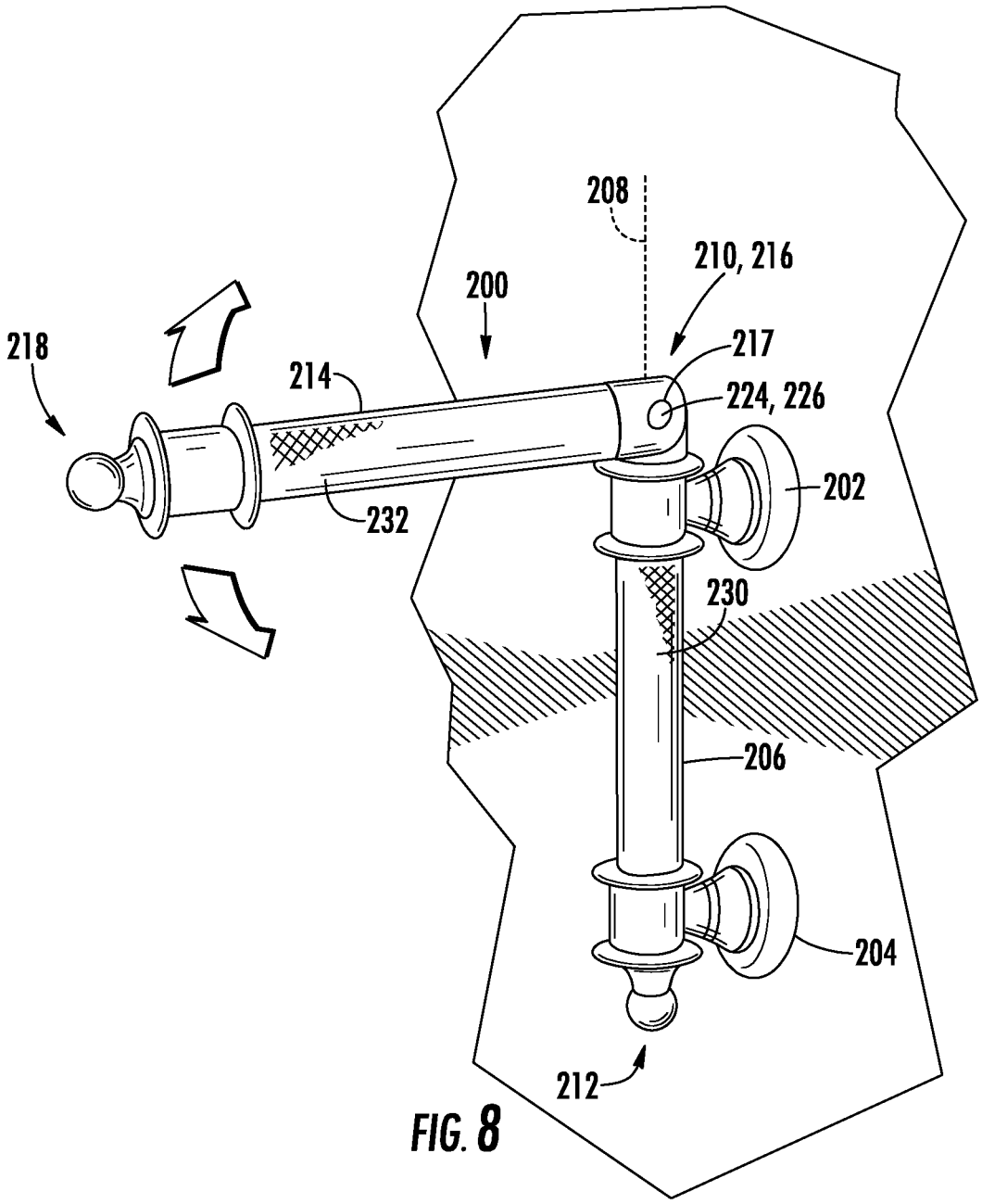
FIG. 8 is a perspective view of the grab bar assembly of FIG. 7 in a second position.

FIGS. 7-8 illustrate a handle assembly 200 or grab bar assembly 200 according to another embodiment. The assembly 200 has first and second mounts 202, 204, with each mount having associated hardware to fasten or connect the mount 202, 204 to a surface, such as a vertical wall in or adjacent to a bathing enclosure.

A first handle 206 or first grab bar 206 is provided and extends along a longitudinal axis 208 as shown. The first grab bar 206 has first and second end regions 210, 212 that are connected to and fixed relative to the first and second mounts 202, 204, respectively. In one example, the mounts 202, 204 are provided with brackets to hold the first grab bar 206. The first grab bar 206 and longitudinal axis 208 may be oriented vertically or substantially vertically, e.g. within five to ten degrees of vertical. The first and second mounts 202, 204 may therefore be mounted to the wall along an axis parallel to the longitudinal axis 208 of the first grab bar 206.

The mounts 202, 204 may be dimensioned to position the first grab bar 206 at a specified distance from the wall surface. In one example, the first grab bar 206 is positioned with 1.5 inches of space or more between the first grab bar 206 and the wall surface or more. The first grab bar 206 may be fixed against translational or rotational movement.

The grab bar assembly 200 has a second handle 214 or second grab bar 214 with third and fourth end regions 216, 218. The third end region 216 is connected for rotation to the first end region 210 of the first grab bar 206, for example via a hinge mechanism 217, such that the second grab bar 214 is moveable from a first position with the second grab bar 214 coaxially aligned with the first grab bar 206 to a second position with the second grab bar 214 angled relative to the first grab bar 206 for grasping by a user. The second grab bar 214 may extend linearly for grasping by a user and, in one non-limiting example, has a length of up to twelve inches.

FIG. 8 illustrates the second grab bar 214 in the second position. FIG. 7 illustrates the second grab bar 214 being moved between the first and second positions. The second grab bar 214 may be coaxial with the longitudinal axis 208 in the first position, for example for storage with the second grab bar 214 being adjacent to, parallel to, or in contact with the wall surface. The second grab bar 214 may be horizontal and perpendicular to the first grab bar 206 in the second position for grasping and use by a user, or substantially horizontal, e.g. within five to ten degrees of horizontal. A cover member may be provided to surround the hinge joint to maintain clearance room for the movement.

The grab bar assembly 200 may be provided with a third mount 220 for mounting to the wall. The third mount 220 may be aligned with the first and second mounts 202, 204, with the first mount 202 positioned between the second and third mounts 204, 220. The third mount 220 may be provided with a clip, fastener, or the like to selectively connect to the fourth end region 218 of the second grab bar 214 to retain the grab bar in the first position and for storage of the second grab bar adjacent to the wall surface. In other examples, the third mount 220 and the fourth end region 218 may be provided with attractive magnets to retain the second grab bar to the mount in the first position.

The grab bar assembly 200 may be provided with a locking mechanism 224 to maintain the second grab bar 214 within a horizontal or substantially horizontal plane. The locking mechanism 224 may include a clip, ramp surfaces, or locking pin that engages the second grab bar 214 in the second position and requires an input to release the second grab bar 214 for movement to the first position. In other examples, the grab bar assembly 200 may be provided without this locking mechanism 224, and only have a limit surface to prevent the second grab bar 214 from rotating past horizontal.

The second grab bar 214 may additionally pivot about the longitudinal axis 208, for example, between a plurality of positions with the second position being one of these. A hinge mechanism, a bushing, or the like may be provided to allow for the rotational movement of the second grab bar 214 relative to the first grab bar 206. For example, the second grab bar 214 may rotate or pivot from the second position to a third position for grasping by the user by pivoting the fourth end region 218 of the second grab bar 214 about the longitudinal axis 208 of the first grab bar 206. The second grab bar 214 may have additional rotational positions to those shown, and in one example, is configured to move through up to 270 degrees of rotation after being mounted to a wall, e.g. near a corner. In other examples, the second grab bar may be limited to move through another range of motion, such as 180 degrees or 90 degrees based on the mounting location, as well as the intended use.

In various examples, the grab bar assembly 200 has a pivotal locking mechanism 226, which may be provided similarly to that described above with respect to locking mechanism 124. The locking mechanism 226 locks the second grab bar 214 in one of a plurality of pivotal positions relative to the first grab bar 206. The grab bar assembly 200 may have two pivotal positions as described, or may have additional positions that are uniformly or non-uniformly rotationally spaced about the first grab bar 206. In one non-limiting example, a pivotal position for the second grab bar 214 is provided every 45 degrees through a range of motion of up to 270 degrees about the first grab bar 206. In another non-limiting example, a pivotal position for the second grab bar 214 is provided every 20-25 degrees through a range of motion of up to 180 degrees.

In various examples, the outer surface 230 of the first grab bar 206 and/or the outer surface 232 of the second grab bar 214 may be provided with a textured surface and/or a coating 234 to provide additional grip for a user. For example, a textured surface may be provided by a knurled pattern, or another pattern or texture. A coating may be provided by a rubberized coating or the like. The coating may provide a softer surface, and may be solid, semi-transparent, or transparent.

Figure 9:
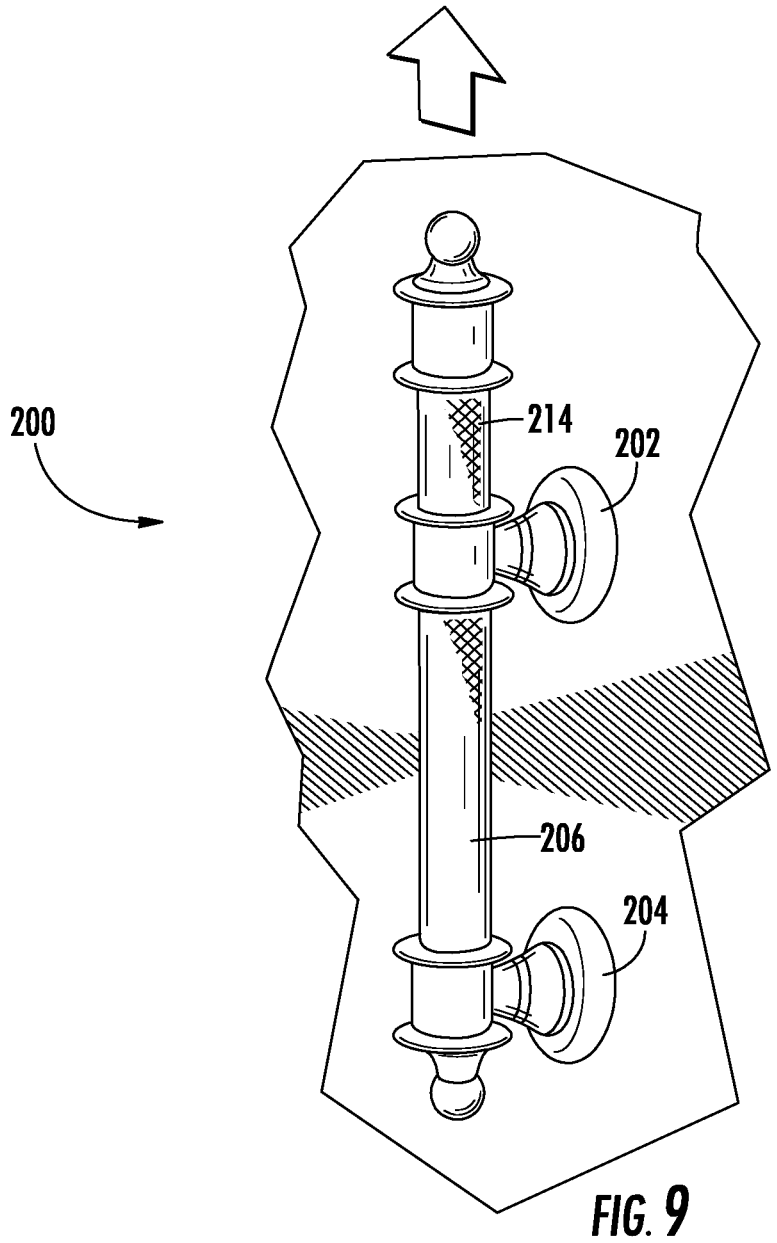
FIG. 9 is a perspective view of a grab bar assembly in a first position according to another embodiment.
Figure 10:
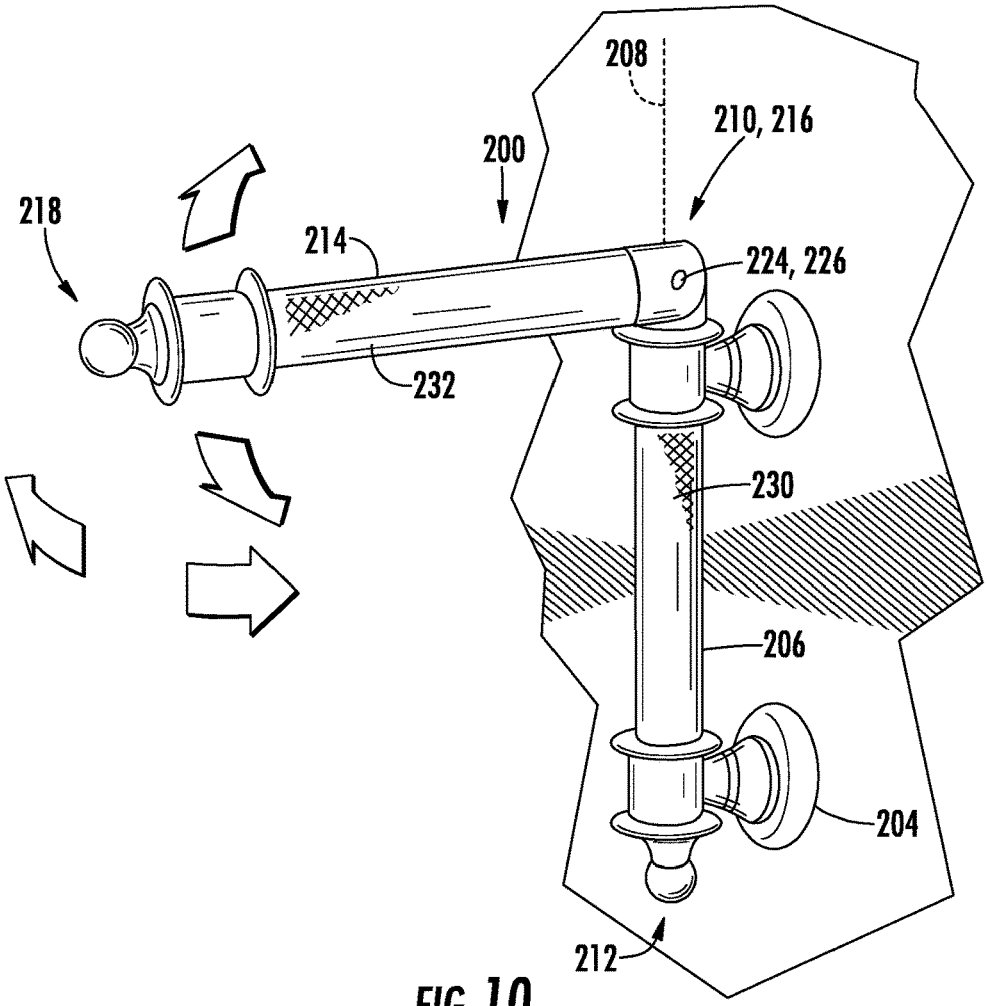
FIG. 10 is a perspective view of the grab bar assembly of FIG. 9 in a second position.
Figure 11:
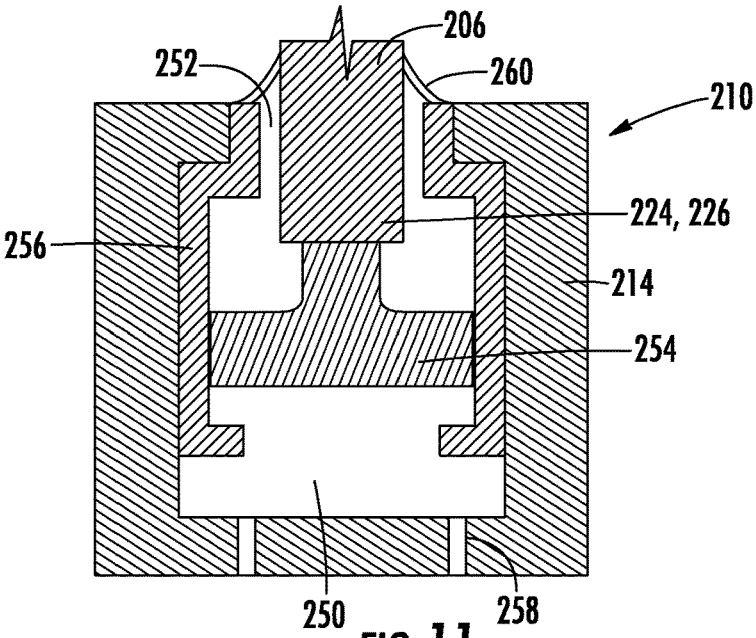
FIG. 11 is a partial cross-sectional view of the grab bar assembly of FIG. 9.

FIGS. 9-11 illustrate a grab bar assembly 200 according to another embodiment. Elements that are the same as or similar to those described above with reference to FIGS. 7-8 are given the same reference number for convenience.

In addition to the rotational movement from the first position to the second position, and pivotal movement between second and third positions, the third end region 216 of the second grab bar 214 may slide or translate relative to the first grab bar 206. The first grab bar 206 defines an interior hollow region that intersects an aperture 252 in the first end region 210 of the first grab bar 206.

The third end region 216 of the second grab bar 214 has a slider 254 that is positioned within the hollow region 250 and has a larger diameter than the aperture 252. With the second grab bar 214 in the first position, the slider 254 may translate along axis 208 within the first grab bar 206 towards the second end region 212. The second grab bar 214 therefore slides into the hollow region 250 of the first grab bar and telescopes within the first grab bar 206 to provide a storage position with at least a portion of the second grab bar 214 being positioned with the hollow interior 250 of the first grab bar. In one example, only a portion of the second grab bar 214 is received within the first grab bar 206. In another example, the second grab bar 214 is largely received by the first grab bar, with only the fourth end region 218 protruding to provide a grasping point for the user.

In various examples, a bushing 256, sleeve, or other material with a low coefficient of friction may be provided within the hollow region 250 to act as a guide and interface with the outer surface of the second grab bar 214 to ease movement of the second grab bar and prevent scratching the surface finish of the second grab bar. The bushing 256 is positioned within the hollow interior 250 of the first grab bar between an outer wall of the second grab bar 214 and an inner wall of the first grab bar 206.

The first grab bar 206 may additionally be provided with drain channels 258 fluidly connecting the hollow interior 250 with the outside environment to allow for liquid drainage from the hollow interior, for example, when the grab bar assembly 200 is used in a bathing enclosure. A sealing member 260 may be provided adjacent to the aperture 252 and surrounding the second grab bar 214 to assist in preventing liquid from entering the hollow interior 250 of the first grab bar.

The grab bar assemblies 100, 200 as described herein may be formed from a metal, a plastic, or a combination of metal and plastic components. Furthermore, grab bar assemblies 100, 200 may be provided with different surface finishes and/or colors, such as brushed or polished chrome, nickel, white, and the like.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A handle assembly comprising:

first and second mounts, each mount to mount to a wall;

a first handle extending along a longitudinal axis between first and second end regions, the first and second end regions connected to and fixed relative to the first and second mounts, respectively;

a second handle having third and fourth end regions each connected for rotation to the first handle such that the second handle pivots about the longitudinal axis, the third and fourth end regions spaced apart from one another such that an outer surface of the first handle therebetween is accessible for grasping by a user; and a locking mechanism to lock the second handle in one of a plurality of pivotal positions relative to the first handle, the locking mechanism with an engagement member to move in a radial direction relative to at least one of the first and second handles between an engaged position and a release position;

wherein the engagement member of the locking mechanism is connected to the first handle:

wherein the second handle defines a plurality of apertures with each aperture associated with one of the plurality of pivotal positions to receive the engagement member and engage the locking mechanism; and wherein the engagement member extends outwardly through one of the plurality of apertures in an engaged position and is moved radially inwardly to release the locking mechanism and move the second handle.

2. The handle assembly of claim 1 wherein the longitudinal axis of the first handle is oriented vertically; and wherein the second handle has a first linear section adjacent to the third end region and substantially perpendicular to the first handle, the first linear section for grasping by the user.

3. The handle assembly of claim 2 wherein the second handle has a second linear section adjacent to the fourth end region, the second linear section for grasping by the user.

4. The handle assembly of claim 1 wherein a longitudinal axis of the first handle is oriented vertically.

5. The handle assembly of claim 1 wherein the first and second mounts mount to the wall along an axis parallel to the longitudinal axis of the first handle.

6. The handle assembly of claim 1 wherein at least one of the first and second handles has at least one of a textured surface and a coated surface.

7. A handle assembly comprising:

first and second mounts, each mount to mount to a wall;

a first handle extending along a longitudinal axis between first and second end regions, the first and second end regions connected to and fixed relative to the first and second mounts, respectively;

a second handle having third and fourth end regions each connected for rotation to the first handle such that the second handle pivots about the longitudinal axis, the third and fourth end regions spaced apart from one another such that an outer surface of the first handle therebetween is accessible for grasping by a user; and a locking mechanism to lock the second handle in one of a plurality of pivotal positions relative to the first handle, the locking mechanism with an engagement member to move in a radial direction relative to at least one of the first and second handles between an engaged position and a release position;

wherein the engagement member of the locking mechanism is connected to the first handle and comprises one of a spring pin, a snap button, and a ball; and wherein the second handle defines an aperture associated with each of the plurality of pivotal positions to receive the engagement member and engage the locking mechanism.

8. The handle assembly of claim 7 wherein the longitudinal axis of the first handle is oriented vertically; and wherein the second handle has a first linear section adjacent to the third end region and substantially perpendicular to the first handle, the first linear section for grasping by the user.

9. The handle assembly of claim 8 wherein the second handle has a second linear section adjacent to the fourth end region, the second linear section for grasping by the user.

10. The handle assembly of claim 7 wherein a longitudinal axis of the first handle is oriented vertically.

11. The handle assembly of claim 7 wherein the first and second mounts mount to the wall along an axis parallel to the longitudinal axis of the first handle.

12. The handle assembly of claim 7 wherein at least one of the first and second handles has at least one of a textured surface and a coated surface.

* * * * *